US008179279B2

(12) United States Patent
Voss

(10) Patent No.: US 8,179,279 B2
(45) Date of Patent: May 15, 2012

(54) METHOD AND DEVICE FOR PRODUCING HYDROCARBONS USING WIRELESS COMMUNICATION

(75) Inventor: Robert K. Voss, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 559 days.

(21) Appl. No.: 12/393,673

(22) Filed: Feb. 26, 2009

(65) Prior Publication Data

US 2009/0212969 A1 Aug. 27, 2009

Related U.S. Application Data

(60) Provisional application No. 61/031,578, filed on Feb. 26, 2008, provisional application No. 61/056,725, filed on May 28, 2008.

(51) Int. Cl.
*G01V 3/00* (2006.01)
*E21B 47/16* (2006.01)
*E21B 43/01* (2006.01)

(52) U.S. Cl. ..... 340/854.6; 340/853.2; 367/82; 166/335; 455/557

(58) Field of Classification Search ..... 340/853.1, 340/854.3, 854.6–854.7, 853.2; 367/81, 367/82; 166/335, 338, 363; 455/557
See application file for complete search history.

(56) References Cited

U.S. PATENT DOCUMENTS 4,095,421 A 6/1978 Silcox
4,730,677 A * 3/1988 Pearce et al. ..... 166/345
6,109,352 A * 8/2000 Edwards et al. ..... 166/336
7,261,162 B2 8/2007 Deans et al.
2002/0011580 A1 * 1/2002 Johansen et al. ..... 251/129.1
2003/0150619 A1 * 8/2003 Meaders ..... 166/360
2004/0244980 A1 * 12/2004 Appleford et al. ..... 166/305.1
2005/0072574 A1 * 4/2005 Appleford et al. ..... 166/366
2006/0042799 A1 3/2006 Hosie et al.
2007/0231072 A1 * 10/2007 Jennings et al. ..... 405/75
2008/0042869 A1 2/2008 Zimmerman

FOREIGN PATENT DOCUMENTS

EP 0919697 A2 6/1999

(Continued)

OTHER PUBLICATIONS

FMC Technologies Information Sheet for Subsea Control Systems (7 pages).

(Continued)

*Primary Examiner* — William P Neuder
*Assistant Examiner* — Catherine Loikith
(74) *Attorney, Agent, or Firm* — Bracewell & Giuliani LLP

(57) ABSTRACT

A subsea production system adapted for wireless communication so that production tree operation can be controlled locally wirelessly from a workover umbilical or remotely controlled vehicle. The production system includes a wellhead assembly and an umbilical termination connected to an umbilical that extends to above the sea surface. Dedicated wireless communication devices can be attached to one or both of the wellhead assembly and the umbilical termination. The wireless communication devices can include a radio frequency modem, a sonar device, an infrared communication device, a light emitting diode, an optical modem, and combinations thereof; the wireless communication can include radio frequency waves, acoustic waves, and electromagnetic waves. A subsea control module can be included for controlling/actuating devices in or associated with the production system. The subsea control module can be adapted for wireless communication.

17 Claims, 2 Drawing Sheets

FOREIGN PATENT DOCUMENTS

| | | |
|---|---|---|
| WO | WO 00/01922 | 1/2000 |

OTHER PUBLICATIONS

Wireless fibre systems; http://www.wirelessfibre.co.uk/home.htm; Dec. 4, 2007 (2 pages).

Wireless fibre systems; http://www.wirelessfibre.co.uk/products.htm; Dec. 4, 2007 (1 page).

Tritech International; Underwater Radio Modem—S1510; Oct. 2007 Joint Issue 14 (2 pages).

* cited by examiner

METHOD AND DEVICE FOR PRODUCING HYDROCARBONS USING WIRELESS COMMUNICATION

CROSS REFERENCE TO RELATED APPLICATIONS

This application claims priority to and the benefit of co-pending U.S. Provisional Application Ser. No. 61/031,578, filed Feb. 26, 2008, and co-pending U.S. Provisional Application Ser. No. 61/056,725, filed May 28, 2008, the full disclosures of which are hereby incorporated by reference herein.

BACKGROUND

1. Field of Invention

This invention relates in general to production of oil and gas wells, and in particular to a system and method for subsea communication using radio frequency signals.

2. Description of Prior Art

Systems for producing oil and gas from subsea wellbores typically include a subsea wellhead assembly that includes a wellhead housing attached at a wellbore opening, where the wellbore extends through one or more hydrocarbon producing formations. Casing and tubing hangers are landed within the housing for supporting casing and production tubing inserted into the wellbore. The casing lines the wellbore, thereby isolating the wellbore from the surrounding formation. Tubing typically lies concentric within the casing and provides a conduit for producing the hydrocarbons entrained within the formation. Wellhead assemblies also typically include a production tree connecting to the upper end of the wellhead housing. The production tree controls and distributes the fluids produced from the wellbore.

Valve assemblies are typically provided within wellhead production trees for controlling the flow of oil or gas from a wellhead and/or for controlling circulating fluid flow in and out of a wellhead. Gate valves and other sliding stem-type valves have a valve member or disc and operate by selectively moving the stem to insert/remove the valve member into/from the flow of fluid to stop/allow the flow when desired. A subsea control module (SCM) can be provided with the subsea production system for operating the valves on the tree as well as other valves in the downhole production tubing and subsea manifold. Control commands directing SCM action may be initiated above the sea surface and transmitted down a communications link consisting of an umbilical that connects to an umbilical termination and leads connecting the umbilical termination to the SCM. The leads are susceptible to damage, either from the subsea environment or structurally from production or workover operations. Additionally, the leads can hinder wellhead assembly maintenance or repair, especially when a remotely operated vehicle is deployed subsea.

Currently control rooms for subsea wells can be located many miles away from the actual well and its associated production tree. Typically a production umbilical links the production tree with the control room. During workover operations a workover umbilical is lowered from a floating rig or work boat and leads from the workover umbilical are connected to the tree after disconnecting the production umbilical. Alternatively, without disconnecting the production umbilical, to actively control the production tree from the floating rig requires contacting the control room, usually by radio, to request production control relinquish priority to the workover crew. Communications issues sometimes interfere with passing control authority to the workover, that can harm production or be hazardous to personnel or equipment.

SUMMARY OF INVENTION

The present disclosure includes a subsea system for use in producing hydrocarbons. In an example, a subsea wellhead assembly in fluid communication with a wellbore with a subsea control module on the wellhead assembly, a production umbilical termination in communication with a production tree control facility, a control line connected between the production umbilical termination and the subsea control module, and a workover umbilical termination in overriding wireless communication with the subsea control module, so that the subsea control module is responsive to communication from the workover umbilical termination. The system, in one embodiment, includes a subsea wellhead assembly in fluid communication with a wellbore, a wireless communication device on the wellhead assembly, a workover umbilical termination selectively in wireless communication with the wireless communication device, and a production umbilical in communication above the sea surface and connected on an end to a production umbilical termination. A radio frequency modem can be included with the umbilical termination. The wireless communication device on the wellhead assembly can have a radio frequency modem, so that the wireless communication can be radio frequency waves. A light emitting diode is optionally included with the umbilical termination. The wireless communication device on the wellhead assembly can be a light emitting diode so that the wireless communication comprises electromagnetic waves. Alternatively, an infrared communication device can be on the umbilical termination. The wireless communication device on the wellhead assembly can be an infrared communication device so that the wireless communication comprises electromagnetic waves in the infrared spectrum. An optical modem can be included with the umbilical termination. The wireless communication device on the wellhead assembly can be an optical modem so that the wireless communication comprises electromagnetic waves. An acoustic transducer can be included with the umbilical termination. The wireless communication device on the wellhead assembly can be an acoustic transducer device so that the wireless communication comprises acoustic waves. The acoustic transducer can be a sonar communication device. A remotely operated vehicle deployed subsea can be included that is selectively in wireless communication with at least one of the wellhead assembly and the umbilical termination. A subsea control module can be included adapted to receive wireless control commands from the umbilical termination. The system can also include a sensor in wireless communication with the umbilical termination. A subsea manifold can be included that is in wireless communication with at least one of the umbilical termination and the wellhead assembly. The umbilical termination can be a production umbilical termination or a workover umbilical termination. The system can include a lead connected between the umbilical termination and the wellhead assembly with control signals communicating in the lead between the umbilical termination and the wellhead assembly.

Also disclosed herein is a method of operating a subsea hydrocarbon producing system. In an embodiment the producing system can include a subsea wellhead assembly, a subsea workover umbilical termination in wireless communication with the wellhead assembly that overrides communication from a production control facility. The method can include communicating from the surface to the umbilical termination through the umbilical, and communicating a wireless signal from the umbilical termination to the wellhead assembly thereby providing communication from the surface to the wellhead assembly.

DETAILED DESCRIPTION OF THE INVENTION

Figure 1:
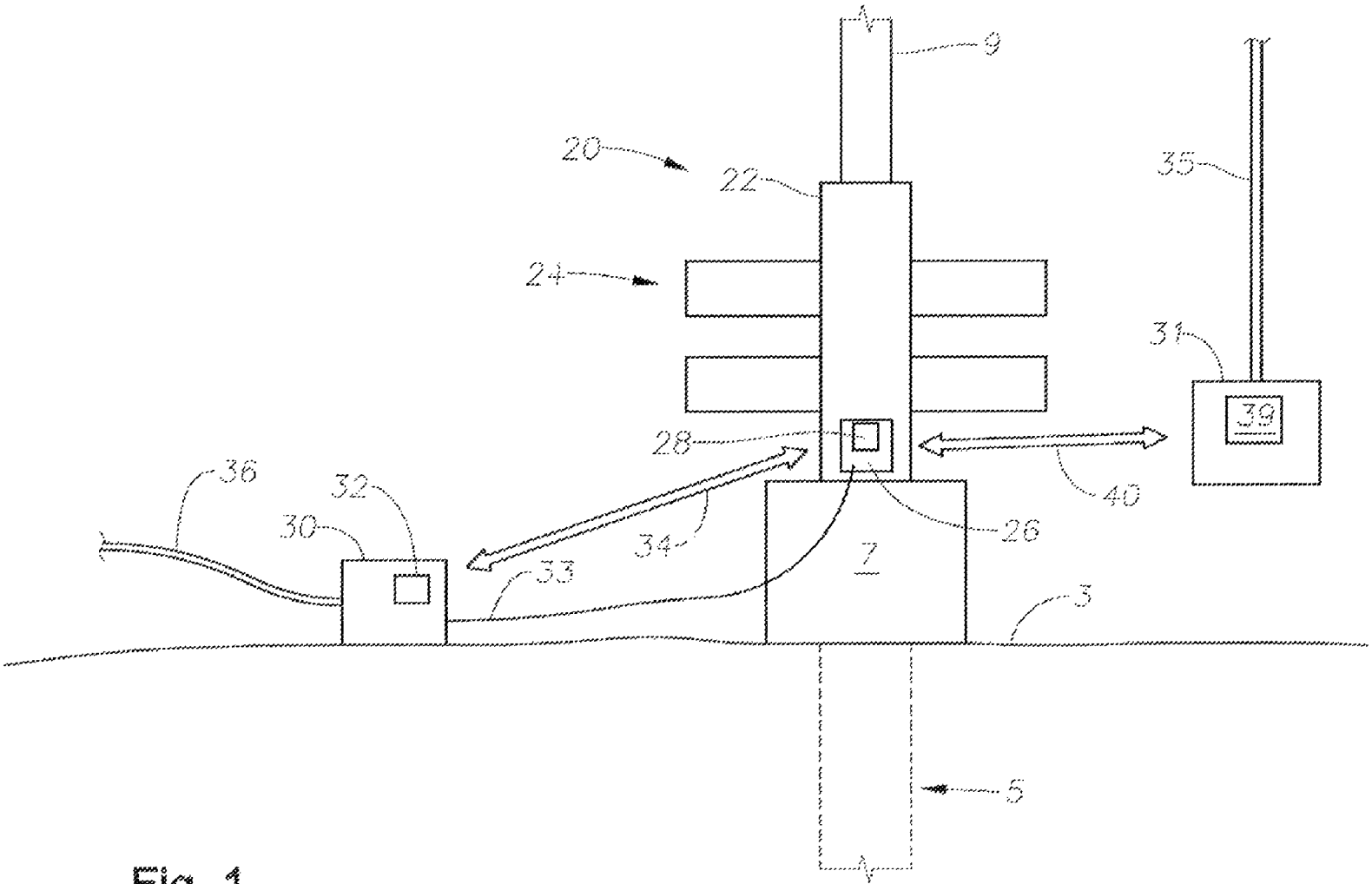
FIG. 1 is a schematical view of a subsea system in installation/workover mode having a production tree and umbilical termination utilizing RF communication.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides a side schematical view of a subsea production system utilizing communication using radio frequency transducers. The production system includes a wellhead assembly 19 shown having a production tree 20 coupled to a wellhead housing 7 anchored to the sea floor 3 over a cased wellbore 5. The wellbore 5 considered for use with the method and system described herein is not limited to hydrocarbon producing wellbores, but can include any wellbore, including those used in the transmission of produced hydrocarbons from a subsea formation. The production tree 20 depicted includes a body 22 with lateral members 24 extending therefrom. The lateral members 24 are configured to include valves and valve actuators. Thus selective manipulation of the valves within the lateral members 24 may be required during production tree 20 operation.

The production system described herein includes communication devices adapted for wireless communications. Wireless communications include sending and/or receiving wireless signals, such as radio frequency signals, electromagnetic signals, acoustic signals, and combinations thereof. The electromagnetic signals considered for use in the wireless communications described herein include signals in the visible spectrum and infrared spectrum. Also included are signals within monochromatic light, coherent light, and collimated light, including laser light. In one example, a wireless signal is any signal transmitted or received without using a wire or cable. The signals can include control commands for directing control of a component or device within the production system. The signals can also include data, such as from temperature, pressure, or flow sensors. As will be discussed in more detail below, the communications devices may be radio frequency transducers, light emitting diodes, optical modems, acoustic devices, such as sonar, infrared devices, and any device or transducer configured to transmit and/or receive wireless data via light emitting diode(s), infrared signal(s), optical modem(s), an acoustic device, or sonar.

The production tree 20 is shown further including a subsea control module 26 disposed on its outer body 22. Control modules can be located on other sections of the wellhead assembly 19, examples include, in the wellhead housing 7, within the tree 20 housing, or proximate to the production tree 20. The control module 26 may include electrical and/or hydraulic controls for providing control or actuation of components associated with the production tree 20. A wireless communications device 28 is shown included in conjunction with the subsea control module 26 that can transmit and receive wireless signals. The wireless communications device 28 can include one of the devices discussed above. In an example where the wireless communications device 28 is a radio frequency (RF) transducer, it is adapted to send and/or receive radio frequency waves, including waves with a modulated signal thereon. The RF transducer 28 can also demodulate the signal from the carrier wave for A/D conversion. One example of a suitable RF transducer is provided by Tritech International Ltd., Peregrine Road, Westhill Business Park, Aberdeen AB32 6JL, United Kingdom, telephone: 44 (0) 1224 744 111. Optionally, the radio frequency transducer may be equipped primarily for transmitting a radio wave carrying a signal or simply for receiving and demodulating such a wave. In one example, the radio frequency transducer operates in a 20 MHz to about 6 GHz frequency band. Optionally, the radio frequency transducer operates at any frequency, or band of frequencies, within this frequency band.

An example of a production umbilical termination 30 is provided in a schematical side view and disposed on the seafloor 3. Connected to the umbilical termination 30 is an umbilical 36 for conveying power and/or communication means from the sea surface to the umbilical termination 30. The umbilical 36 can be connected on its other end to a production control facility or control room. The umbilical termination 30 may be a production umbilical termination. A control line 33 (also referred to as an electrical flying lead) can be provided between the production umbilical termination 30 and the subsea control module 26. Primary power and control for the subsea control modules 26 can be provided via this line. As such, information to and from the control module 26 and the control room can be transmitted via the control line 33.

Included with the umbilical termination 30 is an RF transducer 32 shown receiving/transmitting RF communication 34 from/to the RF transducer 28 on the subsea control module 26. The RF transducer 28 is shown in direct data communication with the control module 26 via a direct connection. Thus any data read or obtained by the control module 26 may optionally be uploaded or uplinked to its associated RF transducer 28. Similarly, the RF transducer 32 is shown in direct data communication with the umbilical termination 30. As such, the RF communication 34 redundantly closes an information loop, therefore providing communication between the production tree 20 and the surface. For example, instructions from surface may be transmitted in digital signal form via the umbilical 36 to the umbilical termination 30 and uplinked to its associated RF transducer 32. The instructions may be converted from a digital form into a radio wave (schematically represented by RF communication 34) and transmitted via the RF communication 34 to the RF transducer 28. The RF transducer 28 then demodulates and converts the radio signal into digital data and communicates to the subsea control module 26. Preprogrammed actions may then be affected on the production tree 20 via the data received by the subsea control module 26.

Similarly, subsea information from the production tree 20 is transmissible to surface by the communication link. For example, operational or ambient information may be uplinked to the RF transducer 28 from the production tree 20 for transmission to the surface via the RF communication 34, RF transducer 32, umbilical termination 30, and umbilical 36. Operational mode examples include production control systems as well as installation work over control systems. The modes of transmission between adjacent or communicating radio frequency transducers includes subsea control module in installation, work over, as well as backup intervention control system (BUICS).

The system of FIG. 1 further includes a capability of communication subsea with a workover umbilical termination 31. A workover umbilical termination 31 is shown subsea secured to an associated umbilical 35. The workover umbilical termination 31 includes an associated RF transducer 39 that is in direct communication with the umbilical termination 31. RF communication 40 may then occur between the workover umbilical 31 and the subsea control module 26 via the RF communication 40.

The associated RF transducer 32 is configured to communicate with the RF transducer 28 on the subsea control module 26 in situations when a backup or redundant communication and/or control means is required. Thus the RF transducer 32 may include a battery backup enabling operation when primary control and power is lost. Switching between primary to battery power may be configured to occur when a fault or discontinued primary service is detected. With regard to the control system, when a workover umbilical termination 31 is in use the subsea control module 26 is configurable to automatically change from a production control system (PCS) to an installation work over control system (IWOCS). Accordingly, the workover team can seamlessly override commands from the control room to locally control the production tree 20 from the workover vessel. This eliminates relying on communication between the workover vessel and primary control room to begin production tree 20 control. Additionally, wireless communication between the workover termination 31 and the tree 20 eliminates the need for attaching control lines. This can significantly reduce the time and expense required for a workover operation, especially if connecting the control lines requires an ROV.

Figure 2:
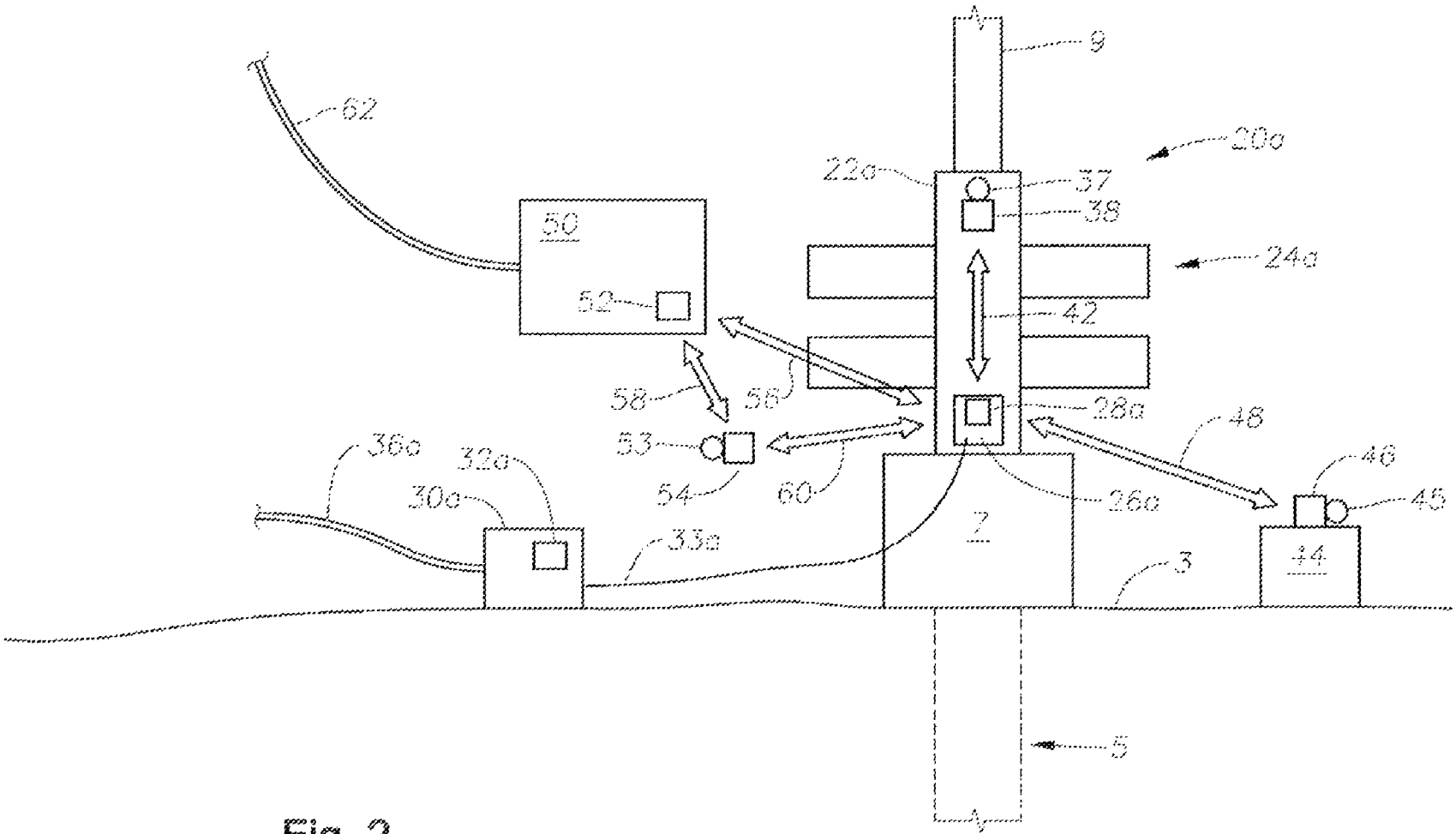
FIG. 2 is a schematical view of a subsea system in production mode having a production tree, sensors, and Remotely Operated Vehicle utilizing RF communication.

FIG. 2 provides an alternative system for communicating in a subsea well production system. Shown is a production tree 20*a* comprising a body 22*a* having lateral members 24*a* extending laterally from the body 22*a*. A subsea control module 26*a* is provided on the body 22*a*. An RF transducer 28*a* is provided for use in association with the subsea control module 26*a*. The system of FIG. 2 further includes sensors configured for recording production flow through the body and ambient conditions including temperature and pressure. A subsea manifold 44 is shown disposed on the sea floor 3. A sensor 45 is shown disposed with the manifold 44. An RF transducer 46 is in data communication with the sensor 45. Thus RF communication 48 may take place between the sensor 45 and the subsea control module 26*a*. Other sensors 37, 53 are provided on and proximate to the production tree 20*a* with respective associated radio frequency transducers 38, 54. The combination sensor and transducer may communicate with the subsea control module wherein the control module 26*a* may retain or transmit the received data to the surface via 36*a*.

The system of FIG. 2 may further include an ROV 50 with an associated RF transducer 52, where the ROV 50 is in communication to the surface by its umbilical 62. RF communication 56 takes place between the RF transducer 52 and the RF transducer 28*a*. Similar to the workover umbilical, the RF transducer 52 can be configured to override production tree 20*a* control from the control room thereby allowing local control via the ROV 50. Optionally, direct RF communication 58 may take place between the RF transducer 52 of the ROV 50 and the sensors disposed subsea. Thus communication, data recording, and subsea control may take place via the umbilical 62 to subsea from the surface.

Primary control and power for the subsea control module 26*a* of FIG. 2 may be provided via the production umbilical termination 30*a* and through control line 33*a*. Secondary or redundant power and control commands may be provided to the production umbilical termination 30*a* via its associated umbilical 36*a*. RF communication (not shown) may occur between the RF transducer 32*a* of the production umbilical termination 30*a* and any one of another subsea disposed RF transducer.

One of the advantages of the system of FIG. 2 is realized when an ROV 50 is employed, hardwire connections are not required in order to operate in connection with the ROV 50. Thus flying lead connections are not disturbed in this configuration. Moreover, this system can be utilized having multiple subsea control modules.

While the invention has been shown or described in only some of its forms, it should be apparent to those skilled in the art that it is not so limited, but is susceptible to various changes without departing from the scope of the invention.

What is claimed is:

1. A subsea system for producing hydrocarbons comprising:

a subsea wellhead assembly in fluid communication with a wellbore;

a subsea control module on the wellhead assembly;

a production umbilical termination disposed subsea and in communication with a production tree control facility;

a control line connected between the production umbilical termination and the subsea control module; and a workover umbilical termination selectively disposed subsea so that when hydrocarbons are being produced from the wellbore, the subsea control module is controlled using the control line, and when a workover operation is taking place on the subsea system, the subsea control module is controlled by commands sent wirelessly from the workover umbilical termination.

2. The system of claim 1, further comprising a radio frequency modem with at least one of the production umbilical termination and the workover umbilical termination, and wherein the wireless communication device on the wellhead assembly comprises a radio frequency modem so that the wireless communication comprises radio frequency waves.

3. The system of claim 1, further comprising a light emitting diode with at least one of the production umbilical termination and the workover umbilical termination, and wherein the wireless communication device on the wellhead assembly comprises a light emitting diode so that the wireless communication comprises electromagnetic waves.

4. The system of claim 1, further comprising an infrared communication device with at least one of the production umbilical termination and the workover umbilical termination, and wherein the wireless communication device on the wellhead assembly comprises an infrared communication device so that the wireless communication comprises electromagnetic waves in the infrared spectrum.

5. The system of claim 1, further comprising an optical modem with at least one of the production umbilical termination and the workover umbilical termination, and wherein the wireless communication device on the wellhead assembly comprises an optical modem so that the wireless communication comprises electromagnetic waves.

6. The system of claim 1, further comprising an acoustic transducer with at least one of the production umbilical termination and the workover umbilical termination, and wherein the wireless communication device on the wellhead assembly comprises an acoustic transducer device so that the wireless communication comprises acoustic waves.

7. The system of claim 1, further comprising a sensor in wireless communication with at least one of the production umbilical termination and the workover umbilical termination.

8. The system of claim 1, further comprising a subsea manifold in wireless communication with at least one of the production umbilical termination, the workover umbilical termination, and the wellhead assembly.

9. A method of operating a subsea hydrocarbon producing system comprising:

controlling the production of hydrocarbons from a subsea wellhead assembly by communicating with a control module on the producing system from a control facility above sea surface;

suspending a workover umbilical termination subsea from a workover umbilical;

communicating wirelessly between the wellhead assembly and the workover umbilical termination;

performing a workover on the producing system by overriding commands from a production umbilical terminal to the wellhead assembly using wireless signals emitted from the workover umbilical termination; and controlling the wellhead assembly with wireless signals emitted from the workover umbilical termination.

10. The method of claim 9, further comprising coupling a radio frequency modem with the workover umbilical termination and the wellhead assembly and communicating radio frequency waves between the workover umbilical termination and the wellhead assembly, wherein the waves have a frequency of at least about 20 MHz.

11. The method of claim 9, further comprising coupling a light emitting diode with the workover umbilical termination and wellhead assembly and communicating electromagnetic waves between the workover umbilical termination and the wellhead assembly with their respective light emitting diodes.

12. The method of claim 9, further comprising coupling an infrared communication device with the workover umbilical termination and wellhead assembly and communicating electromagnetic waves in the infrared spectrum between the workover umbilical termination and the wellhead assembly with their respective infrared communication devices.

13. The method of claim 9, further comprising coupling an optical modem with the workover umbilical termination and wellhead assembly and communicating electromagnetic waves between the workover umbilical termination and the wellhead assembly with their respective optical modems.

14. The method of claim 9, further comprising coupling an acoustic transducer with the workover umbilical termination and wellhead assembly and communicating acoustic waves between the workover umbilical termination and the wellhead assembly with their respective acoustic transducer.

15. The method of claim 9, further comprising providing on the wellhead assembly a subsea control module coupled with a wireless communication device and communicating wireless commands from the workover umbilical termination to the subsea control modem for controlling the wellhead assembly.

16. The method of claim 15, wherein the workover umbilical is suspended from a workover vessel disposed above the producing system and wherein workover operations are controlled by signals sent from the workover vessel.

17. A method of operating a subsea hydrocarbon producing system that includes a subsea wellhead assembly controlled by a subsea control module, a subsea production umbilical termination, and an umbilical connected to the umbilical termination and extending to a control facility, the method comprising:

controlling operating of the producing system with commands from the control facility that are transmitted though the umbilical;

deploying a remotely controlled vehicle subsea;

communicating wirelessly between the wellhead assembly and the remotely controlled vehicle;

overriding commands from the production umbilical terminal to the wellhead assembly to automatically change the subsea control module from a production control system to an installation workover control system; and controlling the wellhead assembly with wireless signals emitted from the remotely controlled vehicle.

* * * * *